US010448165B2

(12) United States Patent
Backman et al.

(10) Patent No.: US 10,448,165 B2
(45) Date of Patent: Oct. 15, 2019

(54) AUDIO TRANSDUCER WITH ELECTROSTATIC DISCHARGE PROTECTION

(71) Applicant: Nokia Corporation, Espoo (FI)

(72) Inventors: Juha Reinhold Backman, Espoo (FI); Koray Ozcan, Farnborough (GB)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/254,940

(22) Filed: Apr. 17, 2014

(65) Prior Publication Data

US 2015/0304776 A1 Oct. 22, 2015

(51) Int. Cl.

| | |
|---|---|
| ***H04R 9/06*** | (2006.01) |
| ***H04R 7/00*** | (2006.01) |
| ***H04R 7/20*** | (2006.01) |
| ***H04R 9/02*** | (2006.01) |
| ***H04R 1/00*** | (2006.01) |
| *H04R 31/00* | (2006.01) |

(52) U.S. Cl.

CPC ..... *H04R 7/00* (2013.01); *H04R 1/00* (2013.01); *H04R 7/20* (2013.01); *H04R 9/02* (2013.01); *H04R 9/06* (2013.01); *H04R 31/003* (2013.01); *H04R 2207/00* (2013.01); *H04R 2225/49* (2013.01); *H04R 2307/027* (2013.01); *H04R 2307/204* (2013.01); *H04R 2400/11* (2013.01)

(58) Field of Classification Search

CPC ..... H04R 1/06; H04R 1/105; H04R 1/1033; H04R 3/002; H04R 7/122; H04R 7/18; H04R 9/02; H04R 9/025; H04R 9/06; H04R 2209/022; H04R 2225/49; H04R 2499/11; H04R 7/20; H04R 31/003; H04R 2400/11; H04R 2307/204

USPC ..... 381/96, 370, 380, 384, 386, 189, 396, 381/398, 409, 410; 181/171, 172, 167, 181/168

See application file for complete search history.

(56) References Cited

U.S. PATENT DOCUMENTS

| | | | | |
|---|---|---|---|---|
| 2,857,461 A | | 10/1958 | Brodie | |
| 3,061,675 A | | 10/1962 | Ross | |
| 3,665,124 A | * | 5/1972 | Sotome | H04R 9/063 181/171 |
| 4,228,379 A | | 10/1980 | Guscott et al. | 310/322 |
| 4,856,071 A | * | 8/1989 | Marquiss | H04R 1/2857 381/186 |
| 5,406,038 A | | 4/1995 | Reiff et al. | |

(Continued)

FOREIGN PATENT DOCUMENTS

| | | |
|---|---|---|
| CN | 2884763 Y | 3/2007 |
| DE | 3218323 A1 | 11/1983 |

(Continued)

OTHER PUBLICATIONS

"AM229 Series Speaker/Microphone Entrance Panel"; Alpha Communications Product Specification Sheet APS163; Jul. 2013; whole document (1 page).

*Primary Examiner* — Huyen D Le
(74) *Attorney, Agent, or Firm* — Harrington & Smith

(57) ABSTRACT

An apparatus including a transducer configured to generate sound, where the transducer comprises a diaphragm. At least one portion of the transducer is electrically conductive and is configured to provide an electrical connectivity to a ground. The at least one portion, at least in part, circumferences the diaphragm.

23 Claims, 6 Drawing Sheets

(56) References Cited

U.S. PATENT DOCUMENTS

| | | | | |
|---|---|---|---|---|
| 5,878,149 | A | 3/1999 | Hamada | |
| 6,088,466 | A * | 7/2000 | Proni | H04R 9/02 381/397 |
| 6,320,970 | B1 * | 11/2001 | Czerwinski | H04R 1/30 381/340 |
| 8,090,133 | B2 | 1/2012 | Yang | 381/370 |
| 2001/0043713 | A1 * | 11/2001 | Tokusho | H04R 9/06 381/398 |
| 2004/0233597 | A1 | 11/2004 | Chen et al. | |
| 2005/0207610 | A1 | 9/2005 | Kajiwara | |
| 2006/0250731 | A1 | 11/2006 | Parkhurst et al. | |
| 2008/0023259 | A1 * | 1/2008 | Muto | H04R 7/20 181/151 |
| 2008/0278873 | A1 | 11/2008 | Ledue et al. | |
| 2009/0041290 | A1 * | 2/2009 | Yang | H04R 9/06 381/396 |
| 2010/0061055 | A1 | 3/2010 | Dabov et al. | |
| 2010/0150392 | A1 * | 6/2010 | O'neill | H04R 9/022 381/423 |
| 2010/0321854 | A1 | 12/2010 | Lin et al. | |
| 2011/0007929 | A1 * | 1/2011 | Rabu | H04R 1/1033 381/380 |
| 2011/0012747 | A1 | 1/2011 | Hsieh | |
| 2011/0044490 | A1 * | 2/2011 | Makino | H04R 7/20 381/398 |
| 2011/0299718 | A1 * | 12/2011 | Williamson | H04R 7/16 381/423 |
| 2012/0045082 | A1 * | 2/2012 | Wahl | H04R 1/105 381/375 |
| 2012/0063629 | A1 | 3/2012 | Akino | 381/355 |
| 2012/0282719 | A1 | 11/2012 | Tang et al. | 438/51 |
| 2013/0278364 | A1 | 10/2013 | Slotte | 335/209 |
| 2014/0064510 | A1 | 3/2014 | Grinnip, III | |
| 2015/0078611 | A1 * | 3/2015 | Boozer | H04R 7/20 381/398 |

FOREIGN PATENT DOCUMENTS

| | | | |
|---|---|---|---|
| EP | 2876896 | A1 | 5/2015 |
| JP | 2010226441 | A | 10/2010 |
| TW | I269599 | B | 12/2006 |

* cited by examiner

AUDIO TRANSDUCER WITH ELECTROSTATIC DISCHARGE PROTECTION

BACKGROUND

Technical Field

The exemplary and non-limiting embodiments relate generally to a sound transducer and, more particularly, to electrostatic protection.

Brief Description of Prior Developments

Speakers are known which have a metal membrane as a diaphragm.

SUMMARY

The following summary is merely intended to be exemplary. The summary is not intended to limit the scope of the claims.

In accordance with one aspect, an example embodiment is provided in an apparatus comprising a sound transducer diaphragm; and a surround connected to the diaphragm, where the surround comprises at least one portion which is electrically conductive, where the at least one portion is configured to be electrically connected to a ground.

In accordance with another aspect, an example method comprises providing a transducer configured to generate sound, wherein the transducer comprises a diaphragm; positioning at least one portion, which is electrically conductive, at close proximity to the diaphragm; and electrically connecting the at least one portion to at least one electrical conductor, where the at least one electrical conductor is configured to connect the at least one portion to a ground when the at least one electrical conductor is connected to the ground.

In accordance with another aspect, an example embodiment is provided in an apparatus comprising a sound transducer including a movable member comprising a sound transducer diaphragm and a surround connected to the diaphragm, where the sound transducer diaphragm has an outer perimeter which is surrounded by a conductive part, and where the conductive part is configured to be electrically connected to a ground.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
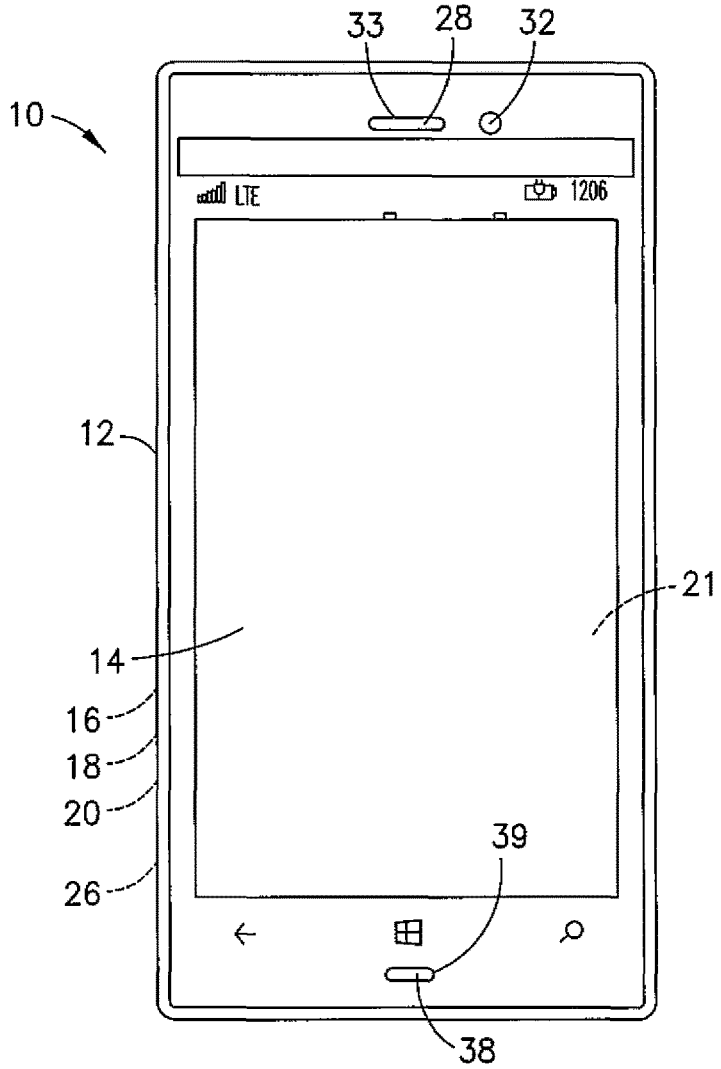
FIG. 1 is a front view of an example embodiment of an apparatus comprising features as described herein.

Referring to FIG. 1, there is shown a front view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 10 may be a hand-held portable apparatus or portable electronic device, such as a communications device which includes a telephone application for example. However features as described herein may be used in other electronic devices such as, for example, a laptop, a desktop computer, a personal computer, a television, or other electronic devices which may be classified as non-portable electronic devices.

In the example shown the apparatus 10 is a smartphone which includes a camera and a camera application. The apparatus 10 may additionally or alternatively comprise an Internet browser application, a video recorder application, a music player and recorder application, an email application, a navigation application, a gaming application, and/or any other suitable electronic device application. In an alternate example embodiment the apparatus might not be a smartphone. For example, the apparatus might be a video recorder or a hand-held gaming device.

Figure 2:
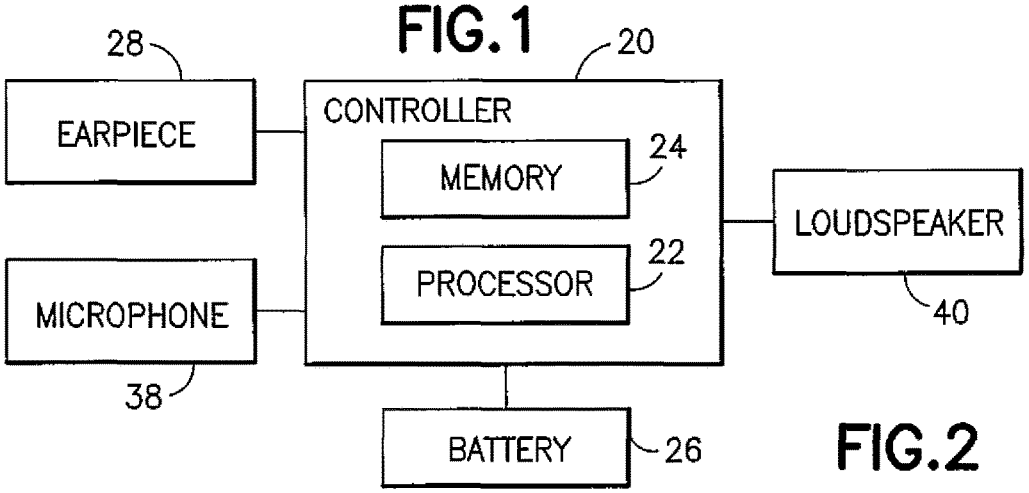
FIG. 2 is a diagram illustrating some of the components of the apparatus shown in FIG. 1.

The apparatus 10, in this example embodiment, comprises a housing 12, a touchscreen 14, a receiver 16, a transmitter 18, a controller 20, a rechargeable battery and at least one camera. However, all of these features are not necessary to implement the features described below. The receiver and the transmitter may be provided in the form of a transceiver for example. Referring also to FIG. 2, the controller 20 may include at least one processor 22, at least one memory 24, and software. The electronic circuitry inside the housing 12 may comprise at least one printed wiring board (PWB) 21 having components such as the controller 20 thereon. The receiver 16 and transmitter 18 form a primary communications system to allow the apparatus 10 to communicate with a wireless telephone system, such as a mobile telephone base station for example.

In this example, the apparatus 10 includes a camera (not shown) which is located at the rear side 13 (see FIG. 3) of the apparatus 10, a front camera 32, and a flash system (not shown) at the rear side 13. The cameras and the flash system are connected to the controller 20 such that the controller 20 may control their operation. In an alternate example embodiment the rear side may comprise more than one camera, and/or the front side could comprise more than one camera. The apparatus 10 includes a sound transducer provided as an air microphone 38. In an alternate example the apparatus may comprise more than one air microphone.

Figure 3:
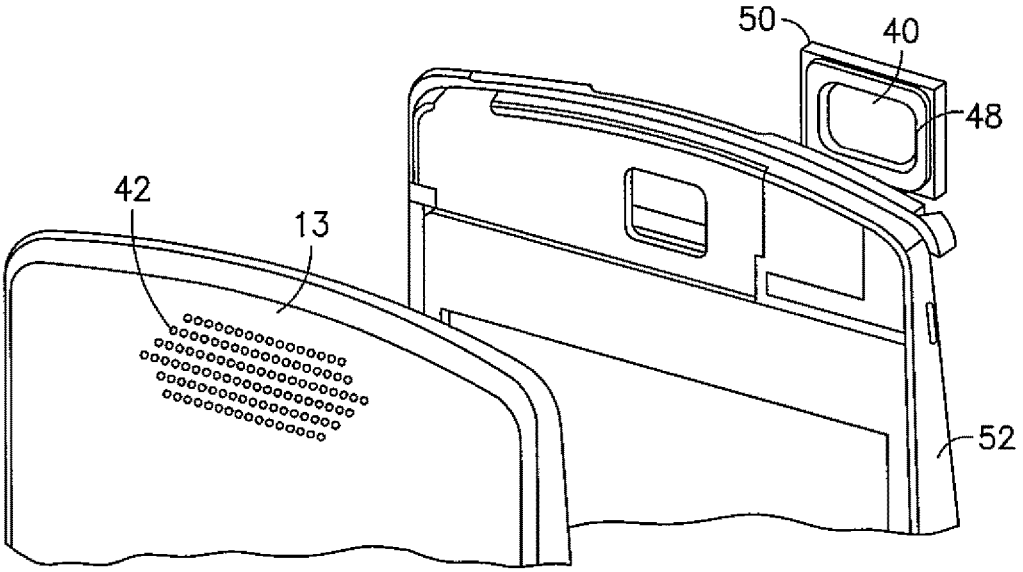
FIG. 3 is a partial exploded perspective view of some of the components of the apparatus shown in FIG. 1.

The apparatus 10 also includes a speaker or earpiece 28 which comprises a sound transducer. Referring also to FIG. 3, the apparatus 10 includes a speaker 40. The housing 12 comprises at least one sound hole 33 in the front side for sound to travel from the earpiece 28, at least one sound hole 39 in the front side for sound to travel to the microphone 38, and sound holes 42 in the rear side 13 (see FIG. 3) for sound to travel from the speaker 40. The description which follows will be in regard to the area at the speaker 40. However, the features described are equally applicable to other coil/magnet assemblies. Features of the invention could be used at the earpiece 28 for example. As well as earpieces, features as described herein may be used for a handsfree speaker or a multi-function-device which is moving coil transducer. In the example shown the diaphragm 48 of the speaker 40 has its outer perimeter connected to a housing 50, by a surround 54 (see FIG. 4), which can be mounted to a backside of a frame piece 52. The speaker 40, in this example, has a coil to thereby be a dynamic moving coil transducer.

Figure 4:
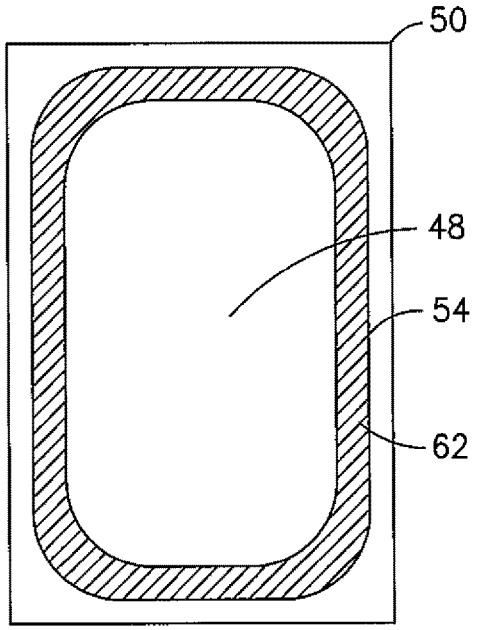
FIG. 4 is a plan view of the front of the speaker shown in FIG. 3.
Figure 5:
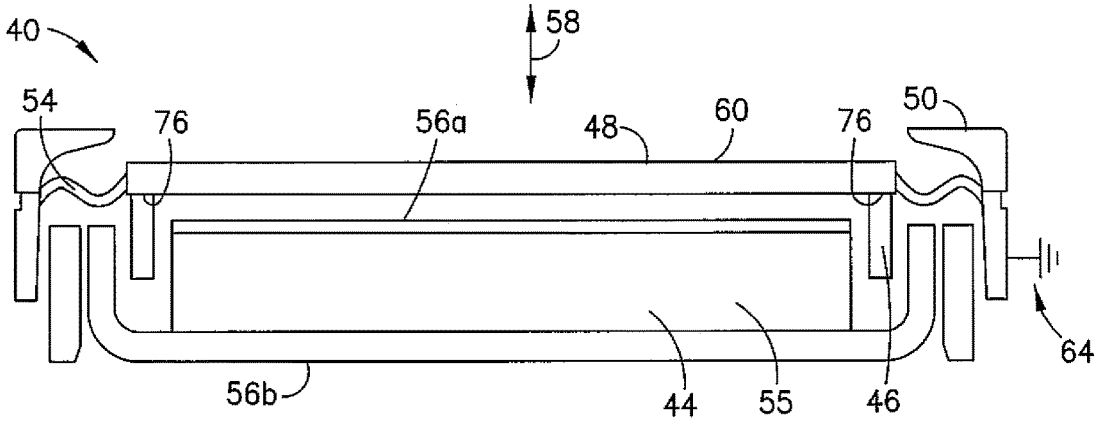
FIG. 5 is a schematic sectional view of the speaker shown in FIG. 3.

Referring also to FIGS. 4-5, in this example the speaker 40 comprises a magnet system 44, a coil 46, the diaphragm 48 connected to the coil 44, the frame 50 and the surround 54. The magnet system 44 comprises at least one permanent magnet 55 and pole pieces 56*a*, 56*b*. In an alternate embodiment the magnet could be an electromagnet. More than two pole pieces could be provided. Some examples of magnet and pole piece arrangements are described and shown in U.S. patent publication No. 2013/0278364 A1 which is hereby incorporated by reference in its entirety.

In the example shown in FIG. 5 the coil 46 is energized to move the coil 46 relative to the magnet system 44. The movement of the coil 46 moves the diaphragm 48 as indicated by arrow 58. In the example shown the diaphragm 48 comprises a membrane 60. The membrane 60 comprises an electrically conductive material. In alternative embodiments the membrane may be a non-conductive material. For example the membrane could be any standard or traditional membrane types. In other alternative embodiments, the membrane could be coated by a conductive material or alternatively the membrane could be metallic i.e. aluminum. The membrane 60 may comprise a layer of aluminum for example. As the membrane 60 is moved as indicated by arrow 58, sound is produced from the speaker 40. The apparatus may further comprise electrical insulation 76 between the metal membrane and the coil.

The surround 54 is attached to both the outer rim of the diaphragm and to the frame. The surround 54 helps center the diaphragm and allows free pistonic motion aligned with the magnetic gap between the magnet and the coil. A purpose of a surround assembly is to accurately reproduce the voice coil signal waveform. A surround assembly may provide a spring functionality for the diaphragm, and it may also naturally provide a dust protection for some transducer designs.

Inaccurate reproduction of the voice coil signal results in acoustical distortion. The ideal for a surround assembly is an extended range of linearity or "pistonic" motion characterized by minimal acoustical breakup of the cone material, minimal standing wave patterns in the diaphragm, and linearity of the surrounds force-deflection curve. The diaphragm stiffness/damping plus the surround's linearity/damping play a role in accuracy of the reproduced voice coil signal waveform. The surround may be resin treated cloth, resin treated non-wovens, polymeric foams, or thermoplastic elastomers over-molded onto the diaphragm body or membrane. An ideal surround has a linear force-deflection curve with sufficient damping to fully absorb vibrational transmissions from the surround interface, and the "toughness" to withstand long term vibration-induced fatigue.

Figure 6:
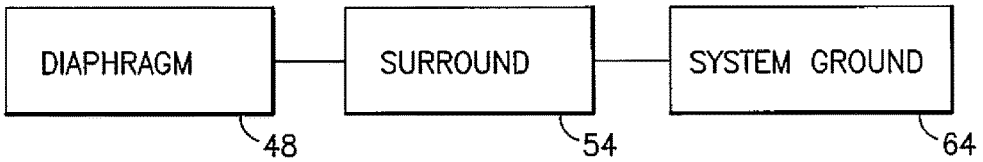
FIG. 6 is a diagram illustrating a ground path including the diaphragm and surround.

In the embodiment shown in FIG. 4, the diaphragm comprises an electrically conductive coating 62. This coating 62 forms an electrical conductor to connect the diaphragm 48 to the frame 50. The frame 50 may be connected to a ground 64. Thus, as shown in FIG. 6, the surround may electrically connect the diaphragm 48 to the ground 64.

Features as described herein may be used in regard to audio transducers and to Electrostatic Discharge (ESD) protection of portable devices. For a smartphone, for example, if electrostatic discharge (ESD) protection is not provided, then it is possible, both in testing and in practical use, that a static discharge directed at the transducer opening (such as an earpiece or loudspeaker for example) actually goes through the voice coil to the audio amplifier. This may damage the audio amplifier. The ESD spark may also damage the diaphragm itself. Earlier transducer designs often employed a perforated metallic front cover, which inherently provided some shielding and could be easily grounded. However, aiming at thinner transducers while simultaneously increasing the displacement has led to the removal of this cover in current designs. Although many conventional miniature transducer designs employ a metal cover that could be grounded to provide the necessary ESD shielding, this approach is not feasible if thin assemblies and/or large diaphragm displacements are desired.

Features as described herein do not require use of a separate conductor wire connected between a diaphragm and a ground contact, and do not require a metal mesh to function as an ESD shield. Features as described herein may comprises a diaphragm, surround, and the magnet assembly and/or frame structure of a dynamic elecroacoustic transducer used as the conductive parts of an ESD shield, making the use of an external shield unnecessary.

In one example embodiment both the transducer diaphragm and the surround may be electrically conductive. The transducer may employ materials such as fully a metallic diaphragm, or metal or carbon fiber composite structure which inherently produce the necessary conductivity for the diaphragm part, and in these designs only the surrounds would need a conductive coating or an embedded conductive element. Other transducers that employ non-conductive base materials may comprise a conductive coating applied over the entire diaphragm and edge surface. The diaphragm and the edge may be manufactured as a single part, which also makes applying a uniform conductive coating easier. In some arrangements the surround could be formed by suitably forming the diaphragm around its edges. It is possible that the surround and the diaphragm could be manufactured as one piece. The surround section of the diaphragm could be coated. Metal coatings are known from some high fidelity tweeters, however, they are not used for ESD shielding purposes, as the tweeter diaphragms are not connected to any ground. They merely are used to increase the bending stiffness of the diaphragm, which can be beneficial also in telecom transducer designs. Another coating suitable for this purpose is a thin graphite or graphene layer. Graphite has the advantage of not altering the elastic properties of the diaphragm or the surround, while grapheme would provide extremely high conductivity. In conventional transducers, metal is not employed as a material for both the diaphragm and the surround.

Figure 7:
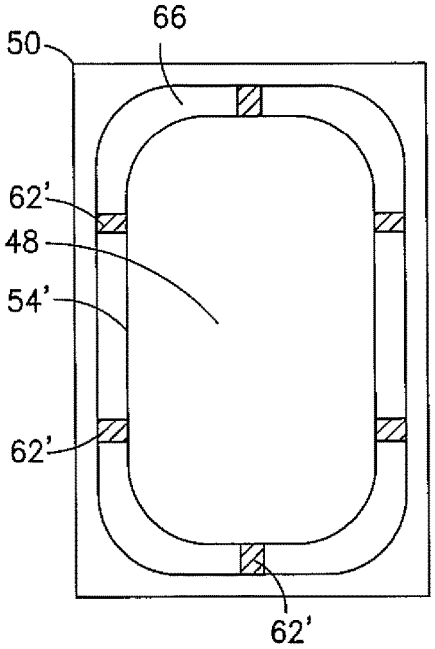
FIG. 7 is a plan view of the front of an alternate example embodiment.
Figure 8:
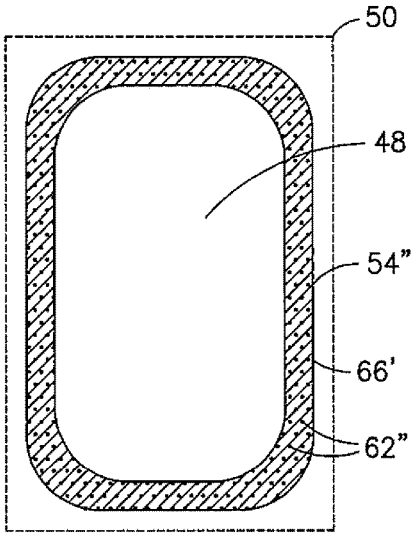
FIG. 8 is a plan view of the front of an alternate example embodiment.

With features as described herein a conductive element may be provided for the surround. This conductive element may be, for example, a metallic coating, conductive fibers embedded in the material, or conductive strips on the surface of the surround. FIG. 7 shows an example where the surround 54' comprises a main member 66 having conductive strips 62' thereon or therein. FIG. 8 shows an example where the surround 54" comprises a main member 66' having conductive fibers 62" embedded in the main member 66'. It should be noted that these types of conductors may affect the vibration properties of the diaphragm and the surround, so their inclusion may be taken into account in the overall design of a transducer component. The metal parts of the loudspeaker (usually, the magnet assembly) can be used as a part of the conductive path. A conductive path around the various parts (iron plates, magnet material) may be provided, because the adhesives usually employed in the assembly are electrically isolating. This conductive element can be also the frame, a metal clamp, or any other suitable structural element. Alternatively, the diaphragm can be connected to a ground terminal on the diaphragm side using a conductive gasket, which can be made of conductive plastic or a non-conductive material with coating. Another way of implementing this is to apply the conductive coating to the surround only and leave the central part of the diaphragm uncoated (i.e., not having any electrically conductive material). If the sound outlet is on the lateral side of the audio transducer, this arrangement would, in practice, provide good shielding.

Features as described herein may be used to remove the need for an external ESD shield, and does not require any additional parts in the audio component itself. This simplifies the assembly and removes the risk from adverse audio quality effects (diaphragm rocking, buzz, etc.) resulting from an additional contact wire. If implemented properly, the ESD shielding may make no significant changes to the currently used transducer manufacturing processes.

Figure 9:
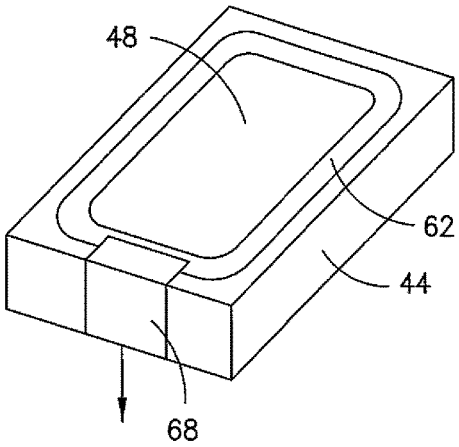
FIG. 9 is a perspective view of an alternate example embodiment.
Figure 10:
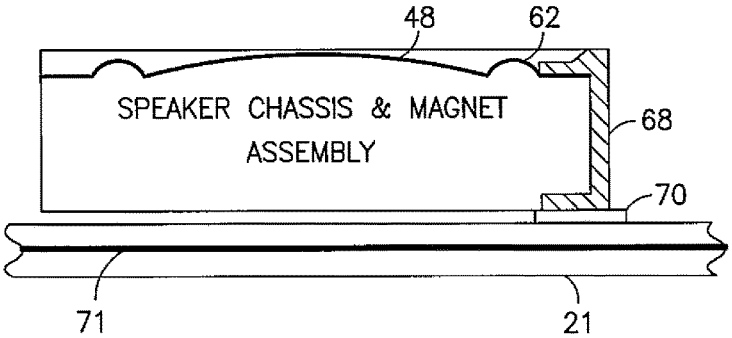
FIG. 10 is a schematic sectional view of the embodiment shown in FIG. 9.

Referring also to FIG. 9, an embodiment is shown comprising the diaphragm 48, an at least partially conductive surround 62 and a conductive clamp 68 on the magnet assembly 44. Referring also to FIG. 10, this arrangement provides a conductive path from the diaphragm-surround assembly towards a ground contact 70, and to a ground layer 71, on the printed wiring board 21 below the drive unit. This can be used, for example, when the magnet assembly and speaker chassis are non-conductive (e.g. due to the glue between the parts of the magnet assembly, which by themselves usually are conductive).

Figure 11:
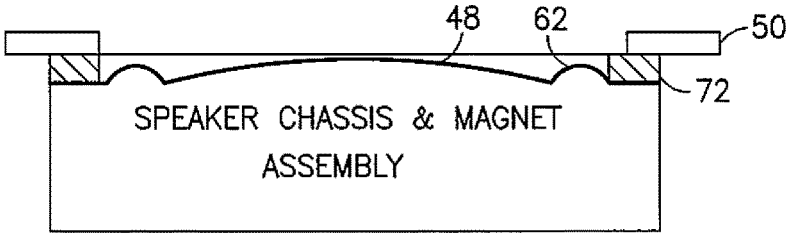
FIG. 11 is a schematic sectional view of another example embodiment.

FIG. 11 illustrates a grounding arrangement when the ground path can be arranged on the diaphragm side of the transducer (e.g. on the cover of the device). The conductive gasket 72 can be made of conductive plastics or plastic foams, or a conventional gasket can be coated with conductive material. A conductive gasket may be positioned around the surround area, and such conductive gasket may be directly connected to the ground. There could be an embodiment where the electrically conductive gasket or conductive clamp are provided, but the surround does not have electrically conductive material. According to an example embodiment, the diaphragm or surround or both could be designed using known solutions (i.e. not being electrically conductive) but a conductive gasket, which is a separate part, could be suitably designed and positioned around the surround area, and such conductive gasket could provide ESD protection for the transducer. The surround does not always have to be electrically conductive. However, as noted above, for the surround having a conductive area, a connection from the conductive area to the ground terminal could be a separate part. In alternative embodiments such connectivity could be provided by one piece, such as the gasket may have an extension suitable for ground connectivity. The ESD protection via conductive part could be provided by coating (or by providing these components with conductive materials) via either of the following possibilities:

diaphragm and surround,
surround,
gasket,
frame/chassis,
sound transducer cover.

Thus, from the description noted above, in some example embodiments the surround may not comprise any conductive part. For example, in a conductive gasket embodiment, the conductive gasket may be a separate part and not connected to either the surround or the diaphragm. The conductive part may also provide other functionalities for the transducer. For example, it is a common practice for a transducer to be integrated inside a portable device where a gasket or adhesive tape is used for positioning and acoustic sealing. A use of a conventional gasket provides acoustic sealing for the transducer integration. According to features as described herein, such gasket may be designated at least in part conductive. In an example embodiment the gasket may be suitably positioned on the front surface of the transducer. The gasket can still provide a sealing functionality, but also the additional functionality of grounding for ESD protection. Thus, one does not need to add any additional parts or sections to the transducer for EDS protection, but can modify and utilize known sections or parts of the transducer assembly for ESD protection. Again in the case of conductive cover, surround, diaphragm, chassis/frame embodiments, these parts are already available in transducers, and one or more of these parts may be modified (by adding electrical conductivity and connectability to ground) to utilize these known parts for ESD protection.

An example embodiment may use a conductive gasket, which may be located around the edges of the transducer chassis and effectively around the perimeter of the diaphragm area. Alternatively, the chassis (the frame) may comprise a conductive, built-in, area located around the diaphragm area which may be connected to the ground.

With features as described herein, no additional conductive terminal needs to be designed inside the transducer. In addition, features as described herein may apply to transducers comprising any diaphragm materials (even non-metallic diaphragms) where the surround structure of the transducer could be designed with conductive material (or conductive coating) or a conductive part (i.e. gasket) sits around the periphery of the diaphragm could be suitably grounded.

Features as described herein do not require that the diaphragm itself must be conductively coated to work because in example solutions the conductive path could be created from the periphery of the diaphragm i.e. via conductive surround or conductive gasket etc for grounding, meaning that the diaphragm need not be coated. With features as described herein the transducer may provide an ESD shield without using additional components where a conductive path (the conductive path could be formed at a pre-determined location) is grounded using an existing component (apart from the electrical terminals of the transducer).

An example embodiment may be provide in an apparatus comprising a sound transducer diaphragm; and a surround connected to the diaphragm, where the surround comprises at least one portion which is electrically conductive, where the at least one portion comprises an electrical connection area configured to be connected, by at least one other member, to a ground of an external member. The at least one portion may have an electrical connection area configured to be connected, by at least one other member, to the ground. In alternative embodiments there may not be at least one other member. For example, if we use a conductive gasket, the conductive gasket may be directly connected to the ground plane of the phone. This may depend on the mechanical construction and integration techniques of the transducer within the mechanic design. Such grounding functionality may happen when the conductive part of the transducer (conductive surround, or conductive surround and conductive diaphragm, or conductive gasket, or conductive frame, etc.) is connected to the ground plane of the mobile phone 10. The external member may be PWB 21 or any other section of the phone 10 which provides either direct or indirect connection to the ground plane of the mobile phone.

The diaphragm may comprise electrically conductive material which is electrically connected to the at least one portion of the surround. The surround and the diaphragm could be formed as a single part in some transducer designs. The diaphragm may comprise a non-electrically conductive membrane. The diaphragm and/or the surround may comprise a coating consisting at least one of metal, graphite, and graphene. The surround may comprise a resilient section having the at least one portion thereon, where the at least one portion comprises an electrically conductive coating on the resilient section and/or one or more conductive elements embedded with the resilient section. The at least one portion of the surround may comprise at least one of a metallic coating, embedded conductive fibers, or conductive strips. A device may be provided where the at least one other member electrically connected to the at least one portion. The at least one other member may comprise at least one of an electrically conductive member of a sound transducer frame, an electrically conductive member of a sound transducer magnet assembly, an electrically conductive gasket, an electrically conductive clamp, and an electrically conductive printed wiring board connector. The device may comprises at least one printed wiring board having the ground; an electrical display connected to the at least one printed wiring board; a receiver connected to the at least one printed wiring board; a transmitter connected to the at least one printed wiring board; a processor connected to the at least one printed wiring board; a memory connected to the at least one printed wiring board; and a battery connected to the at least one printed wiring board.

Figure 12:
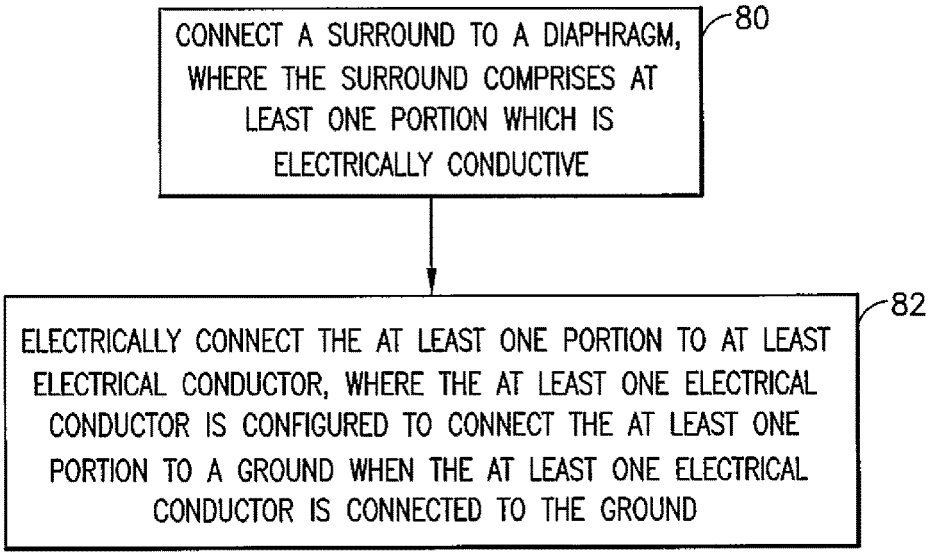
FIG. 12 is a diagram illustrating an example method.

Referring also to FIG. 12, an example method may comprise providing a sound transducer diaphragm; connecting a surround to the diaphragm, where the surround comprises at least one portion which is electrically conductive as illustrated by block 80; and electrically connecting the at least one portion to at least one electrical conductor, where the at least one electrical conductor is configured to connect the at least one portion to a ground when the at least one electrical conductor is connected to the ground as illustrated by block 82. There may be various options as well as the surround which may provide the same functionality. For example, a conductive gasket may be used, a conductive chassis or a conductive cover portion may be used for grounding said transducer for ESD protection.

Connecting the surround to the diaphragm may comprise electrically connecting an electrically conductive section of the diaphragm to the at least one portion of the surround. In alternative embodiments just diaphragm could be conductive, or just the surround could be conductive, or both the diaphragm and the surround could be conductive. Connecting the surround to the diaphragm may comprise not electrically connecting the surround to the diaphragm. The diaphragm and/or the surround may be provided with a coating consisting at least one of metal, graphite, and graphene. The surround may comprise a resilient section having the at least one portion thereon, where the at least one portion comprises an electrically conductive coating on the resilient section and/or one or more conductive elements embedded with the resilient section. The at least one portion of the surround may comprise at least one of a metallic coating, embedded conductive fibers, or conductive strips. The at least one electrical conductor may comprise at least one of an electrically conductive member of a sound transducer frame, an electrically conductive member of a sound transducer magnet assembly, an electrically conductive gasket, an electrically conductive clamp, and an electrically conductive printed wiring board connector. The method may further comprise electrically connecting the at least one electrical conductor to a printed wiring board.

The transducer diaphragm may be circumferentially surrounded by the conductive part. Such conductive part may be the surround, the gasket, and the frame/chassis of the speaker. The conductive part could be assembled onto a transducer, or a transducer could be manufactured using the conductive part.

Figure 13:
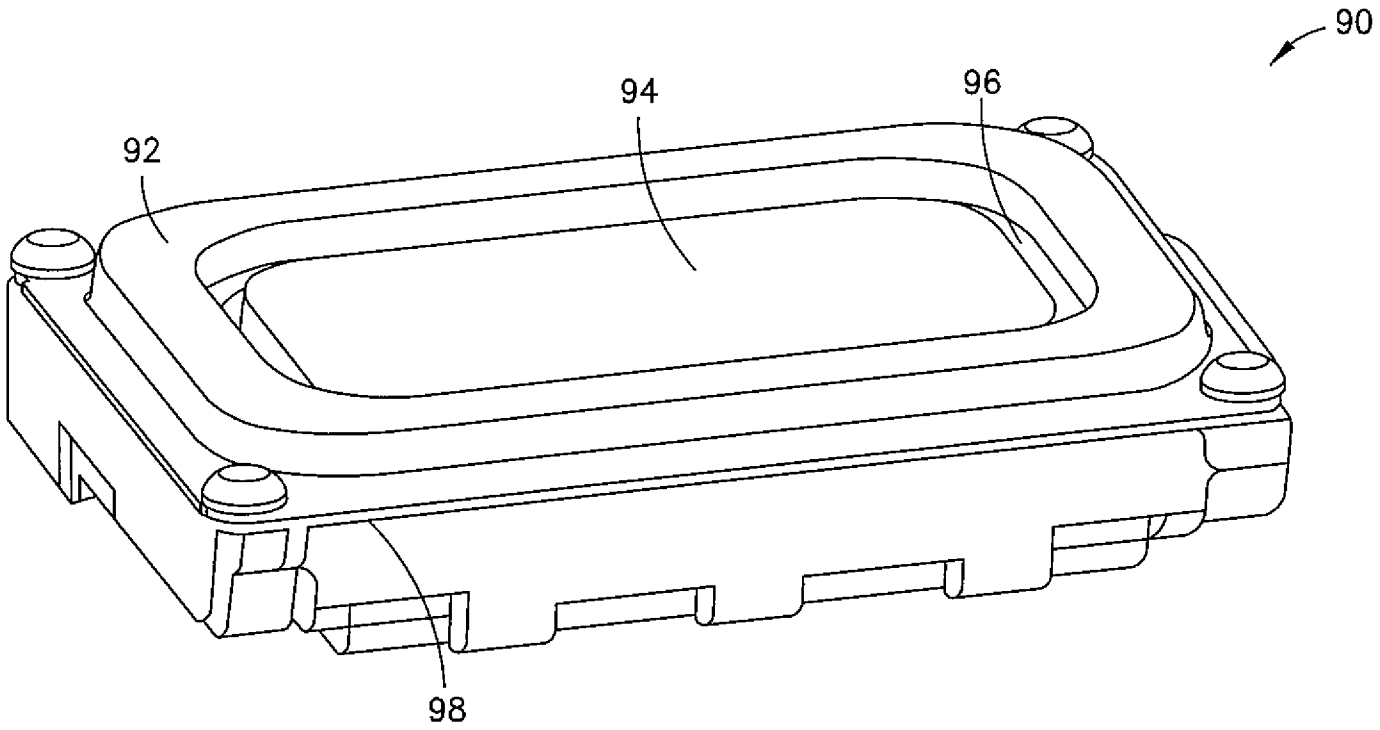
FIG. 13 is a perspective view of a sound transducer comprising features as described herein.

The diaphragm may be coupled to the frame using the surround, and the frame may have a built-in conductive area which can be connected to the ground. Especially in miniaturised transducers, it is fairly common that there is provided a cover structure which either partially or completely covers the transducer diaphragm. In some designs, this cover structure may be coupled to the frame and extend over the diaphragm area. If the dimensions, shape and material of this cover structure are designed suitably, the cover like structure can also provide the same functionality for ESD protection when it is connected to ground. FIG. 13 shows an example of a transducer 90 having a non-conductive diaphragm 94 and surround 96, and an electrically conductive cover 92. Any suitable electrical connection of the cover 92 to the ground of the apparatus 10 could be provided as described herein, such as the frame 98 for example.

An example embodiment may be provide in an apparatus comprising a sound transducer including a movable member comprising a sound transducer diaphragm and a surround connected to the diaphragm, where the sound transducer diaphragm has an outer perimeter which is surrounded by a conductive part, and where the conductive part is configured to be electrically connected to a ground. The conductive part may comprise at least one of: the sound transducer diaphragm, the surround, a gasket, a frame or chassis of the sound transducer, a cover of the sound transducer, an electrically conductive coating on the sound transducer diaphragm, the surround, the gasket, the frame or chassis, or the cover.

Features as described herein may be used for dynamic moving coil transducers as well as other transducer types such as in electro-static or piezo-electric speakers where they have respective membranes for example.

An example embodiment may be provided in an apparatus comprising a transducer configured to generate sound, wherein the transducer comprises a diaphragm, where at least one portion of the transducer is electrically conductive and is configured to provide an electrical connectivity to a ground, where the at least one portion, at least in part, circumferences the diaphragm. As used herein, the term "circumferences" is not limited to a perfect circle shaped ring and may include a general square or rectangular shape as shown in FIGS. 4, 8 and 9 for example. The at least one portion may surround the diaphragm, such as being part of the surround or a gasket for example. The transducer may further comprise a surround connected to the diaphragm, where the surround comprises the at least one portion which is electrically conductive, where the surround is configured to be electrically connected to the ground.

An example method may comprise providing a transducer configured to generate sound, wherein the transducer comprises a diaphragm; positioning at least one portion, which is electrically conductive, at close proximity to the diaphragm; and electrically connecting the at least one portion to at least one electrical conductor, where the at least one electrical conductor is configured to connect the at least one portion to a ground when the at least one electrical conductor is connected to the ground.

Features as described herein may be applied to headphones or ear buds for example. For a headphone, whatever the headphone design may be, the transducer is relatively exposed. Features as described herein may be used to ESD protect the transducer. The ground wire of the headphone is available as a part of a standard headphone connector.

In example embodiments the conductive part may be designed such that it does not fully encircle or ring around the diaphragm. The conductive part may encircle or surround the diaphragm in part. The conductive part may be positioned on a same plane as the diaphragm (such as the conductive surround described above for example) and the conductive part may alternatively or additionally be positioned at a plane which is higher or lower than the position of the diaphragm. For example, a conductive gasket, a conductive cover, etc. may be located at a higher level than the diaphragm area where these conductive parts stay above the diaphragm area after the full assembly.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising a transducer configured to generate sound, wherein the transducer comprises at least one frame member, a diaphragm, and a surround connecting the diaphragm to the at least one frame member, where the surround circumferences the diaphragm to provide spring functionality for the diaphragm and is configured to allow the diaphragm to move relative to the at least one frame member with a substantially pistonic motion, wherein at least one of the at least one frame member or a magnet assembly of the apparatus is at least partially electrically conductive and where the surround is at least partially electrically conductive to at least partially provide a conductive path to a ground of the apparatus for electrostatic discharge protection, wherein the conductive path is provided at least from the at least partially electrically conductive surround towards the ground of the apparatus, wherein the at least partially electrically conductive surround is connected to the ground of the apparatus using the conductive path, where the conductive path is different from electrical terminals of the transducer, where the conductive path is provided at a pre-determined location different from a location of the electrical terminals, and wherein the apparatus is an electronic device.

2. An apparatus as in claim 1 where the diaphragm comprises electrically conductive material which is electrically connected to the conductive path.

3. An apparatus as in claim 1 where the conductive path comprises at least one of:

the sound transducer diaphragm, a gasket, the at least one frame member or chassis of the sound transducer, a cover of the transducer, or an electrically conductive coating on at least one of the diaphragm, the surround, the gasket, the at least one frame member or chassis, an electrically conductive clamp or the cover.

4. An apparatus as in claim 1 where the diaphragm and/or the surround comprises a coating consisting at least one of metal, graphite, or graphene.

5. An apparatus as in claim 1 where the surround comprises a resilient section, where the conductive path comprises an electrically conductive coating on the resilient section and/or one or more conductive elements embedded with the resilient section.

6. An apparatus as in claim 1 where the conductive path is at least partially on or in the surround, connected to the diaphragm, and comprises at least one of a metallic coating, embedded conductive fibers, or conductive strips.

7. An apparatus as in claim 1 where the diaphragm and the surround comprise a common one-piece member.

8. A device comprising:

the apparatus as in claim 1; and at least one other member electrically connected to the conductive path, where the at least one other member connects the conductive path to the ground.

9. A device as in claim 8 where the at least one other member comprises at least one of: an electrically conductive member of a sound transducer frame, an electrically conductive member of a sound transducer magnet assembly, an electrically conductive gasket, an electrically conductive clamp, or an electrically conductive printed wiring board connector.

10. A device as in claim 8 where the conductive path comprises an electrical connection area, and where the at least one other member is connected to the electrical connection area.

11. A device as in claim 8 further comprising:

at least one printed wiring board having the ground;

an electrical display connected to the at least one printed wiring board;

a receiver connected to the at least one printed wiring board;

a transmitter connected to the at least one printed wiring board;

a processor connected to the at least one printed wiring board;

a memory connected to the at least one printed wiring board; and a battery connected to the at least one printed wiring board.

12. An apparatus as in claim 1 wherein a first section of the surround is attached to the at least one frame member and an opposite second section of the surround is attached to the diaphragm.

13. An apparatus as in claim 12 wherein the first section of the surround is attached to the at least one frame member.

14. An apparatus as in claim 1 wherein the surround comprises at least one of: a resin treated cloth, resin treated non-wovens, polymeric foams, or thermoplastic elastomers over-molded onto the diaphragm.

15. An apparatus as in claim 1 wherein the diaphragm comprises a first material, wherein the surround comprises a second different material.

16. A method comprising:

providing a transducer configured to generate sound, wherein the transducer comprises at least one frame member, a diaphragm, and a surround connecting the diaphragm to the at least one frame member, where the surround circumferences the diaphragm to provide spring functionality for the diaphragm and is configured to allow the diaphragm to move relative to the at least one frame member with a substantially pistonic motion; and positioning at least one portion of the surround at close proximity to the diaphragm, wherein at least one of the at least one frame member or a magnet assembly of the transducer is at least partially electrically conductive and where the surround is at least partially electrically conductive to at least partially provide a conductive path to a ground of an apparatus for electrostatic discharge protection, wherein the conductive path is provided at least from the at least partially electrically conductive surround towards the ground of the apparatus, wherein the at least partially electrically conductive surround is connected to the ground of the apparatus using the conductive path, and where the conductive path is different from electrical terminals of the transducer, where the conductive path is provided at a pre-determined location different from a location of the electrical terminals, and wherein the apparatus is an electronic device.

17. A method as in claim 16 further comprising connecting the surround to the diaphragm comprising electrically connecting an electrically conductive section of the diaphragm to the at least one portion using the surround.

18. A method as in claim 16 where the diaphragm and/or the surround is provided with a coating including at least one of: metal, graphite, or graphene.

19. A method as in claim 16 where the surround comprises a resilient section having the at least one portion thereon, where the at least one portion comprises an electrically conductive coating on the resilient section and/or one or more conductive elements embedded with the resilient section.

20. A method as in claim 16 where the surround comprises at least one of a metallic coating, embedded conductive fibers, or conductive strips.

21. A method as in claim 12 where the conductive path comprises at least one of: an electrically conductive member of a sound transducer frame, an electrically conductive member of a sound transducer magnet assembly, an electrically conductive gasket, or an electrically conductive clamp, or an electrically conductive printed wiring board connector.

22. A method as in claim 12 further comprising electrically connecting the conductive path to a printed wiring board.

23. An apparatus comprising:

a sound transducer diaphragm;

a magnet;

a coil; and a surround connected to the sound transducer diaphragm, wherein the surround circumferences the sound transducer diaphragm to provide spring functionality for the sound transducer diaphragm, wherein at least one of at least one frame member of the apparatus or a magnet assembly is at least partially electrically conductive and where the surround is at least partially electrically conductive to provide a conductive path to be connected to a ground of an electronic device for electrostatic discharge protection, where the surround is configured to allow the diaphragm to move relative to the at least one frame member of the apparatus with a substantially pistonic motion, wherein the conductive path is provided at least from the at least partially electrically conductive surround towards the ground of the electronic devide, wherein the at least partially electrically conductive surround is configured to be connected to the ground of the electronic device using the conductive path, where the conductive path is different from electrical terminals of the apparatus, where the conductive path is provided at a pre-determined location different from a location of the electrical terminals, and wherein the apparatus is a sound transducer configured to be located inside the electronic device.

* * * * *